US005701959A

United States Patent [19]

Hushbeck et al.

[11] Patent Number: 5,701,959

[45] Date of Patent: Dec. 30, 1997

[54] DOWNHOLE TOOL APPARATUS AND METHOD OF LIMITING PACKER ELEMENT EXTRUSION

[75] Inventors: Donald F. Hushbeck, Duncan, Okla.; Yusheng Yuan, Houston; Douglas W. Davison, Pearland, both of Tex.

[73] Assignee: Halliburton Company, Duncan, Okla.

[21] Appl. No.: 626,193

[22] Filed: Mar. 29, 1996

[51] Int. Cl.[6] ..... E21B 33/129

[52] U.S. Cl. ..... 166/387; 166/118

[58] Field of Search ..... 166/386, 387, 166/118, 134

[56] References Cited

U.S. PATENT DOCUMENTS 4,730,670 3/1988 Kim ..... 166/203 X 5,540,279 7/1996 Branch et al. ..... 166/118

*Primary Examiner*—William P. Neuder

*Attorney, Agent, or Firm*—Stephen R. Christian

[57] ABSTRACT

An improved downhole tool apparatus and method for limiting the extrusion of packer element seals of packers and bridge plugs which utilize segmented packer retaining shoes when such tools are of larger diameters, or when used at elevated differential pressures or elevated temperatures. Preferably the segmented packer shoes incorporate a plurality of gap-bridging disks to limit if not eliminate unwanted extrusion of the packer elements upon setting of the tool. By making the packer element shoes and disks of non-metallic material, the subject invention increases the ability to drill or mill downhole tools out of a well bore in less time than it would take with using conventional or non-conventional drilling or milling techniques or equipment while providing enhanced high temperature and high pressure performance, especially in larger nominal outside diameter downhole tools.

21 Claims, 4 Drawing Sheets

DOWNHOLE TOOL APPARATUS AND METHOD OF LIMITING PACKER ELEMENT EXTRUSION

FIELD OF THE INVENTION

This invention relates generally to downhole tools for use in well bores and methods of drilling such apparatus out of well bores, and more particularly, to such tools having drillable components made at least partially of composite or non-metallic materials, such as engineering grade plastics, composites, and resins. This invention relates particularly to improvements in preventing undesired extrusion of packer seal elements between segmented non-metallic packer element shoes, alternatively referred to as back-up shoes, back-up rings, retaining shoes, packer shoes, retaining rings, or rings, used to provide support to expandable packer elements used in drillable essentially non-metallic packer and bridge plug type tools. This invention is especially suitable for use with such segmented non-metallic packer element back-up rings having large nominal outside diameters, or with such segmented non-metallic packer element back-up rings having smaller diameters when used in extreme temperature and differential pressure environments which tend to make expandable packer element seals to be more prone to extrusion related damage and possibly failure.

BACKGROUND OF THE INVENTION

In the drilling or reworking of oil wells, a great variety of downhole tools are used. For example, but not by way of limitation, it is often desirable to seal tubing or other pipe in the casing of the well, such as when it is desired to pump cement or other slurry down the tubing and force the cement or slurry around the annulus of the tubing or out into a formation. It then becomes necessary to seal the tubing with respect to the well casing and to prevent the fluid pressure of the slurry from lifting the tubing out of the well or for otherwise isolating specific zones in which a well bore has been placed. Downhole tools referred to as packers and bridge plugs are designed for these general purposes and are well known in the art of producing oil and gas.

When it is desired to remove many of these downhole tools from a well bore, it is frequently simpler and less expensive to mill or drill them out rather than to implement a complex retrieving operation. In milling, a milling cutter is used to grind the packer or plug, for example, or at least the outer components thereof, out of the well bore. Milling is a relatively slow process, but when milling with conventional tubular strings, it can be used on packers or bridge plugs having relatively hard components such as erosion-resistant hard steel. One such packer is disclosed in U.S. Pat. No. 4,151,875 to Sullaway, assigned to the assignee of the present invention and sold under the trademark EZ Disposable packer.

In drilling, a drill bit is used to cut and grind up the components of the downhole tool to remove it from the well bore. This is a much faster operation than milling, but requires the tool to be made out of materials which can be accommodated by the drill bit. Typically, soft and medium hardness cast iron are used on the pressure bearing components, along with some brass and aluminum items. Packers of this type include the Halliburton EZ Drill® and EZ Drill SV® squeeze packers.

The EZ Drill SV® squeeze packer, for example, includes a lock ring housing, upper slip wedge, lower slip wedge, and lower slip support made of soft cast iron. These components are mounted on a mandrel made of medium hardness cast iron. The EZ Drill® squeeze packer is similarly constructed. The Halliburton EZ Drill® bridge plug is also similar, except that it does not provide for fluid flow therethrough.

All of the above-mentioned packers are disclosed in Halliburton Services—Sales and Service Catalog No. 43, pages 2561–2562, and the bridge plug is disclosed in the same catalog on pages 2556–2557.

The EZ Drill® packer and bridge plug and the EZ Drill SV® packer are designed for fast removal from the well bore by either rotary or cable tool drilling methods. Many of the components in these drillable packing devices are locked together to prevent their spinning while being drilled, and the harder slips are grooved so that they will be broken up in small pieces. Typically, standard "tri-cone" rotary drill bits are used which are rotated at speeds of about 75 to about 120 rpm. A load of about 5,000 to about 7,000 pounds of weight is applied to the bit for initial drilling and increased as necessary to drill out the remainder of the packer or bridge plug, depending upon its size. Drill collars may be used as required for weight and bit stabilization.

Such drillable devices have worked well and provide improved operating performance at relatively high temperatures and pressures. The packers and bridge plugs mentioned above are designed to withstand pressures of about 10,000 psi (700 Kg/cm$^2$) and temperatures of about 425° F. (220° C.) after being set in the well bore. Such pressures and temperatures require using the cast iron components previously discussed.

However, drilling out iron components requires certain techniques. Ideally, the operator employs variations in rotary speed and bit weight to help break up the metal parts and reestablish bit penetration should bit penetration cease while drilling. A phenomenon known as "bit tracking" can occur, wherein the drill bit stays on one path and no longer cuts into the downhole tool. When this happens, it is necessary to pick up the bit above the drilling surface and rapidly recontact the bit with the packer or plug and apply weight while continuing rotation. This aids in breaking up the established bit pattern and helps to reestablish bit penetration. If this procedure is used, there are rarely problems. However, operators may not apply these techniques or even recognize when bit tracking has occurred. The result is that drilling times are greatly increased because the bit merely wears against the surface of the downhole tool rather than cutting into it to break it up.

In order to overcome the above long standing problems, the assignee of the present invention introduced to the industry a line of drillable packers and bridge plugs currently marketed by the assignee under the trademark FAS DRILL. The FAS DRILL line of tools consist of a majority of the components being made of non-metallic engineering grade plastics to greatly improve the drillability of such downhole tools. The FAS DRILL line of tools have been very successful and a number of U.S. patents have been issued to the assignee of the present invention, including U.S. Pat. No. 5,271,468 to Streich et al., U.S. Pat. No. 5,224,540 to Streich et al., and U.S. Pat. No. 5,390,737 to Jacobi et al. The preceding patents are specifically incorporated herein.

Notwithstanding the success of the FAS DRILL line of drillable downhole packers and bridge plugs, the assignee of the present invention discovered that certain metallic components still used within the FAS DRILL line of packers and bridge plugs at the time of issuance of the above patents were preventing even quicker drill out times under certain conditions or when using certain equipment. Exemplary situations include milling with conventional jointed tubulars and in conditions in which normal bit weight or bit speed could not be obtained. Other exemplary situations include drilling or milling with non-conventional drilling techniques such as milling or drilling with relatively flexible coiled tubing.

When milling or drilling with coiled tubing, which does not provide a significant amount of weight on the tool being used, even components made of relatively soft steel, or other metals considered to be low strength, create problems and increase the amount of time required to mill out or drill out a down hole tool, including such tools as the assignee's FAS DRILL line of drillable non-metallic downhole tools.

Furthermore, packer shoes and optional back up rings made of a metallic material are employed not so much as a first choice but due to the metallic shoes and back up rings being able to withstand the temperatures and pressures typically encountered by a downhole tool deployed in a borehole.

Another shortcoming with using metallic packer shoes and optional backup rings is that upon deployment of the tool, the typically brass packer shoe may not flare outwardly as the packer portion is being compressed and therefore not expand outwardly as desired. If the brass shoe does not properly flare, it can lead to unwanted severe distortion of the shoes and subsequent cutting of the packer element which reduces its ability to hold to its rated differential pressure or lead to a complete failure of the tool.

To address the preceding shortcomings, the assignee hereof, filed a now pending U.S. patent application on May 5, 1995, Ser. No. 08/442,448, describing and claiming an improved downhole tool apparatus preferably utilizing essentially all non-metallic materials, such as engineering grade plastics, resins, or composites. Primarily, the downhole tool of the 08/442,448 patent application described a well bore packing type apparatus making use of essentially only non-metallic components in the downhole tool apparatus for increasing the efficiency of alternative drilling and milling techniques in addition to conventional drilling and milling techniques and further provided for a segmented non-metallic back-up ring in lieu of a conventional metallic packer shoe having a metallic supporting ring as shown in FIG. 1 herein. The tool discussed in the 08/442,448 patent application preferably employed the general geometric configuration of previously known drillable non-metallic packers and bridge plugs such as those disclosed in U.S. Pat. No. 5,271,468 to Streich et al., U.S. Pat. No. 5,224,540 to Streich et al., and U.S. Pat. No. 5,390,737 to Jacobi et al. while replacing essentially all of the few remaining metal components of the tools disclosed in the preceding patents with non-metallic materials which can still withstand the pressures and temperatures found in many well bore applications. In the '448 invention, the apparatus also comprises specific design changes to accommodate the advantages of using essentially only plastic and composite materials and to allow for the reduced strengths thereof compared to metal components. Additionally, the '448 embodiment comprised a center mandrel and slip means disposed on the mandrel for grippingly engaging the well bore when in a set position, a packing means disposed on the mandrel for sealingly engaging the well bore when in a set position, a slip means comprising a slip wedge positioned around the center mandrel, a plurality of slip segments disposed in an initial position around the mandrel and adjacent to the slip wedge, retaining means for holding the slip segments in an initial position. The slip segments would then expand radially outward upon being set so as to grippingly engage the well bore. Hardened inserts can be molded, or otherwise installed into the slips, and can be metallic such as hardened steel, or non-metallic such as a ceramic material.

In the preferred embodiment of the '448 patent application, the slip means included a slip wedge installed on the mandrel and the slip segments, whether retained by a retaining band or whether retained by an integral ring portion, have coacting planar, or flat portions, which provided a superior sliding bearing surface especially when the slip means were made of a non-metallic material such as engineering grade plastics, resins, phenolics, or composites.

Furthermore, in the '448 patent application, prior art packer element shoes and back up rings, such as those referred to as elements 37 and 38, 44 and 45, in the present assignee's U.S. Pat. No. 5,271,468, and illustrated herein in FIGS. 1 and 2 as elements 24, 26, and 25 respectively, were replaced by a non-metallic packer shoe having a multitude of co-acting non metallic segments and at least one retaining band, and preferably two non-metallic bands, for holding the shoe segments in place after initial assembly and during the running of the tool into the wellbore and prior to the setting of the associated packer element within the well bore.

Nothwithstanding the success of the invention described in the '448 patent application in that tools made in accordance thereto are able to withstand the stresses induced by relatively high differential pressures and high temperatures found within wellbore environments, the assignee of the present invention discovered that when using larger packer type tools, or when using packer type tools in higher temperature and/or higher differential pressure environments, such as those having nominal diameters exceeding six (6) inches, temperatures exceeding 250°, or differential pressures exceeding 10,000 psi, there was a possibility for the non-metallic segmented packer element back-up shoes, also referred to as back-up rings, to allow the packer element to extrude through gaps that are designed to form between the back-up ring segments upon the segments being forced radially outward toward the wellbore surface when the packer element was activated. Upon certain conditions, the larger O.D. packer elements, and smaller O.D. packer elements upon being subjected to elevated pressures and temperatures, were subject to being extruded through these gaps thereby possibly damaging the packer element and possibly jeopordizing the integrity of the seal between the wellbore and the packer element. Thus there remains a need in the art, notwithstanding the improvements discussed in the present Assignee's pending U.S. patent application Ser. No. 08/442,448, for an easily drillable downhole packer-type tool apparatus preferably being made at least partly of, if not essentially entirely of, non-metallic or composite components, and which include expandable packer elements to be partially retained by non-metallic segmented packer element shoes, or retaining rings, that prohibit, or at least significantly reduce, unwanted extrusion of packer elements between gaps of such segmented shoes or segmented rings.

Additional objects and advantages of the invention will become apparent as the following detailed description of the preferred embodiment is read in conjunction with the drawings which illustrate the preferred embodiment of the present invention.

SUMMARY OF THE INVENTION

The present invention provides for a downhole apparatus and a method of limiting the extrusion of packer element installed about a mandrel of a downhole tool. The invention includes a mandrel having an axial centerline, a slip means disposed on the mandrel for grippingly engaging the wellbore when set into position, at least one packer element to be axially retained about the mandrel and located at a preselected position along the mandrel defining a packer element assembly, at least one packer element retaining shoe made of a plurality of segments for axially retaining the at least one packer element about the mandrel, the shoe segments further having a cavity for accommodating at least a portion of at least one gap-spanning structural member, and means for retaining the shoe segments in an initial position about the mandrel wherein the gap-spanning member is of such size and configuration to span a gap that forms between adjacent shoe segments upon the tool being set in the wellbore. Preferably at least one of the shoe segments is made of a phenolic material, or of a laminated non-metallic composite material, or of an engineering grade plastic. Preferably the shoe retaining means comprises at least one retaining band made of a non-metallic material and the shoe has an external face having at least one groove therein to accommodate at least one retaining band. Preferably the gap-spanning structural member is a disk having a packer face, a shoe face, and has a pair of approximately straight sides, the disk is preferably made of a non-metallic material. Furthermore it is preferred that the mandrel be made of a non-metallic composite and the slip means be made at least partially of a non-metallic composite material.

BRIEF DESCRIPTION OF THE DRAWINGS

FIG. 8 is a cross-sectional side view of a packer shoe of the present invention taken along line 8—8 of FIG. 6, with the exception of having a plurality of disk pockets omitted for drawing simplification.

FIG. 9A is a back view of a representative bridging disk to be accommodated by the disk pockets of the shoes shown in FIGS. 5–8.

FIG. 9B is a side view of the disk shown in FIG. 9A.

DESCRIPTION OF THE PREFERRED EMBODIMENTS

Figure 1:
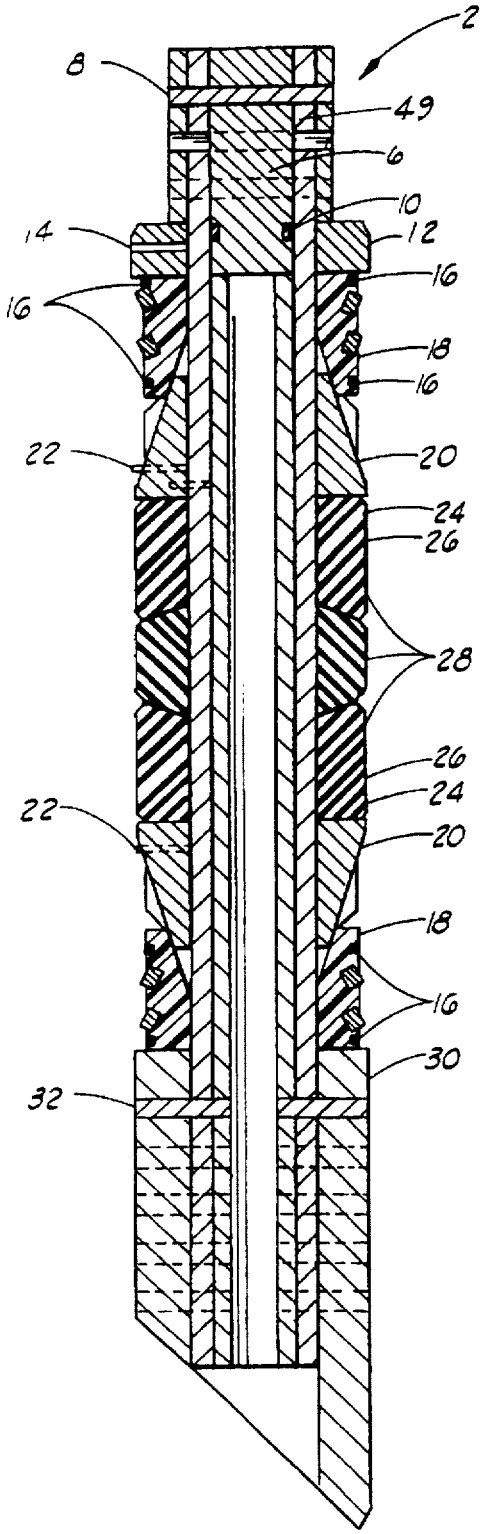
FIG. 1 PRIOR ART
FIG. 1 is a cross-sectional view of a prior art downhole packer apparatus depicting prior art packer element back-up shoe assemblies.
Figure 2:
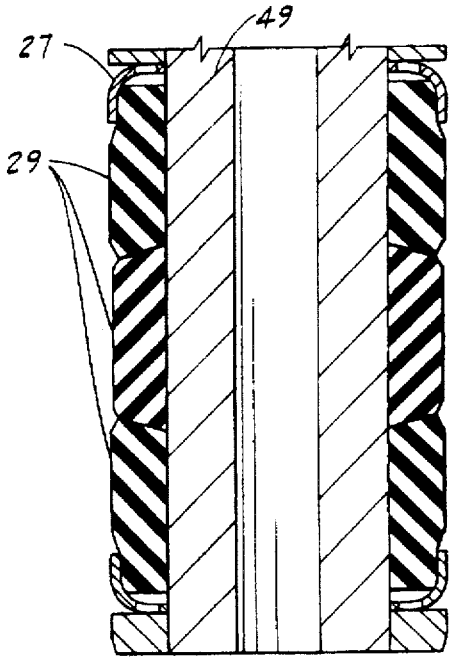
FIG. 2 PRIOR ART
FIG. 2 is a cross-sectional side view of an alternative prior art packer element retainer shoe.

Referring now to the drawings. FIGS. 1–2 are of prior art and have been provided for background and to show a representative tool in which the present invention is particularly suitable for, but not limited to.

Figure 5:
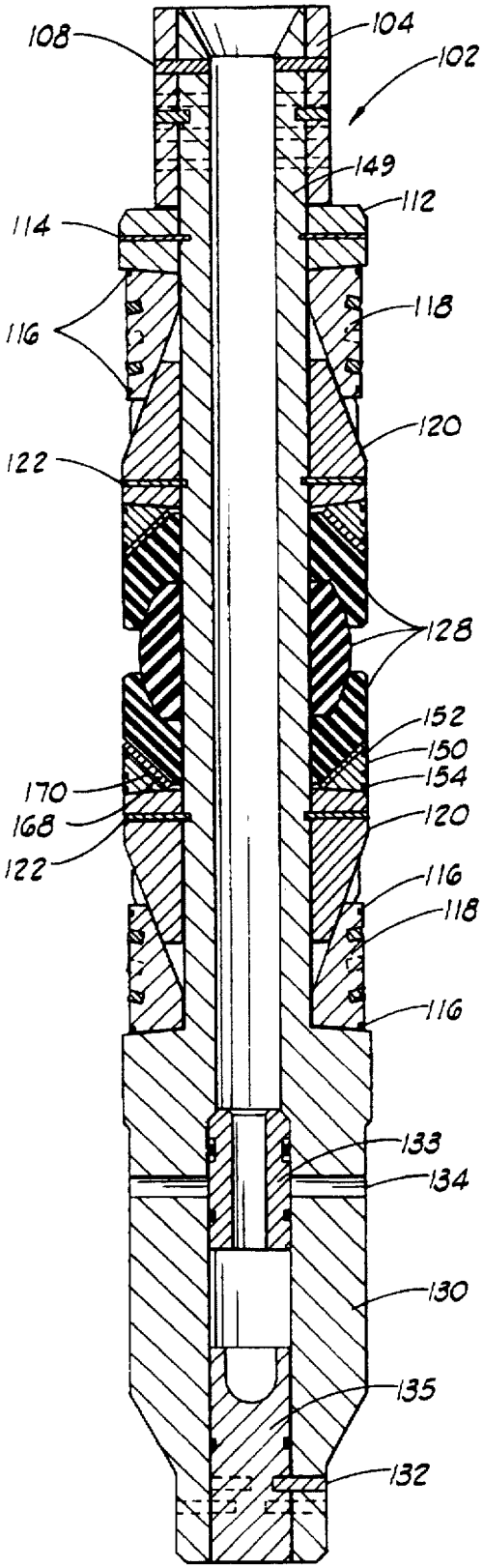
FIG. 5 is a cross-sectional side view of an exemplary packer apparatus having upper and lower packer element shoes embodying the present invention.
Figure 5A:
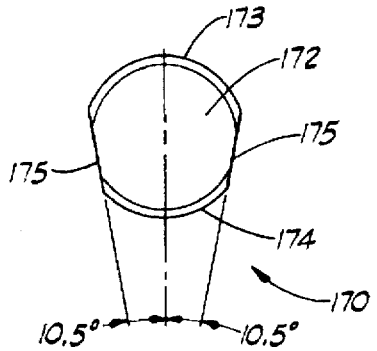
Figure 5B:
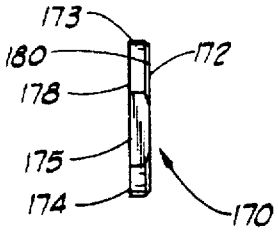
Figure 5:
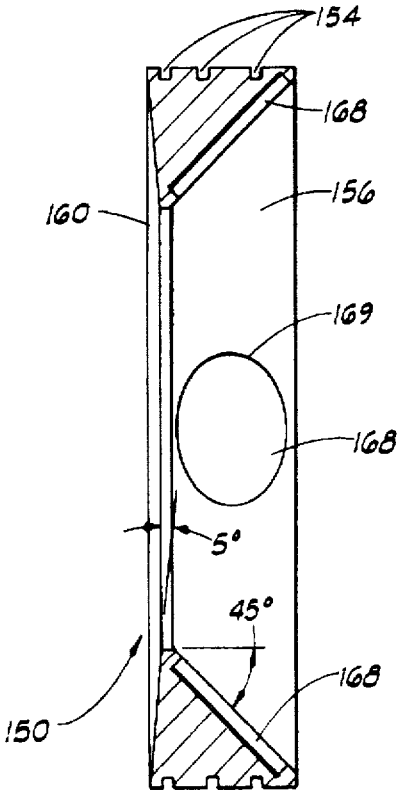

FIG. 1 is a prior art representation of a downhole tool 2 having a mandrel collar 4 and a mandrel 49. The particular tool of FIG. 1 is referred to as a bridge plug due to the tool having a plug 6 being pinned within mandrel 49 by radially oriented pins 8. Plug 6 has a seal means 10 located between plug 6 and the internal diameter of mandrel 49 to prevent fluid flow therebetween. The overall tool structure, however, is quite adaptable to tools referred to as packers, which typically have at least one means for allowing fluid communication through the tool. Packers may therefore allow for the controlling of fluid passage through the tool by way of a one or more valve mechanisms which may be integral to the packer body or which may be externally attached to the packer body. Such a valve mechanism is shown in FIG. 5 of the drawings of the present document.

Packer tools, including the tool shown in FIG. 1, may be deployed in wellbores having casings or other such annular structure or geometry in which the tool may be set.

Tool 2 includes the usage of a spacer ring 12 which is preferably secured to mandrel 49 by pins 14. Spacer ring 12 provides an abutment which serves to axially retain slip segments 18 which are positioned circumferentially about mandrel 49. Slip retaining bands 16 serve to radially retain slips 18 in an initial circumferential position about mandrel 49 as well as slip wedge 20. Bands 16 are made of a steel wire, a plastic material, or a composite material having the requisite characteristics of having sufficient strength to hold the slips in place prior to actually setting the tool and to be easily drillable when the tool is to be removed from the wellbore. Preferably bands 16 are inexpensive and easily installed about slip segments 18. Slip wedge 20 is initially positioned in a slidable relationship to, and partially underneath slip segments 18 as shown in FIG. 1. Slip wedge 20 is shown pinned into place by pins 22. The preferred designs of slip segments 18 and co-acting slip wedges 20 are described in the assignee's 08/442,448 patent application in more detail.

Located below slip wedge 20 is at least one packer element, and as shown in FIG. 1, a packer element assembly 28 consisting of three expandable elements positioned about mandrel 49. At both ends of packer element assembly 28 are packer shoes 26 which provide axial support to respective ends of packer element assembly 28. Backup rings 24 which reside against respective upper and lower slip wedges 20 provide structural support to packer shoes 26 when the tool is set within a wellbore. The particular packer element arrangement show in FIG. 1 is merely representative as there are several packer element arrangements known and used within the art.

Located below lower slip wedge 20 are a plurality of multiple slip segments 18 having at least one retaining band 16 secured thereabout as described earlier.

At the lowermost terminating portion of tool 2 referenced as numeral 30 is an angled portion referred to as a mule-shoe which is secured to mandrel 49 by radially oriented pins 32. However, lowermost portion 30 need not be a mule shoe but could be any type of section which serves to terminate the structure of the tool or serves to be a connector for connecting the tool with other tools, a valve, or tubing etc. It should be appreciated by those in the art, that pins 8, 14, 22, and 32, if used at all, are preselected to have shear strengths that allow for the tool be set and to be deployed and to withstand the forces expected to be encountered in a wellbore during the operation of the tool.

Prior to the invention discussed in U.S. patent application Ser. No. 08/442,448 the use of metallic packer shoes and back up rings were required to be used in the assignee's line of FAS DRILL downhole tool line because of the lack of a suitable non-metallic material being known or available that could withstand the pressures and temperatures typically encountered in a well-bore in which the tool was to be deployed. Additionally, it is known within the art that a downhole tool having a packer element assembly 29 positioned about a mandrel 49, as shown in the broken away cross-sectional view of FIG. 2, having a metallic packer element back up shoe 25 not having a second back up ring to provide additional support to the shoe can be used in certain circumstances. However, a single metallic shoe, such as shoe 27 of prior art FIG. 2, can nonetheless cause problems upon milling or drilling out the tool due to the drill and mill resistant nature of the metallic material of a prior art single shoe, especially when non-conventional milling or drilling techniques are being used.

Figure 3:
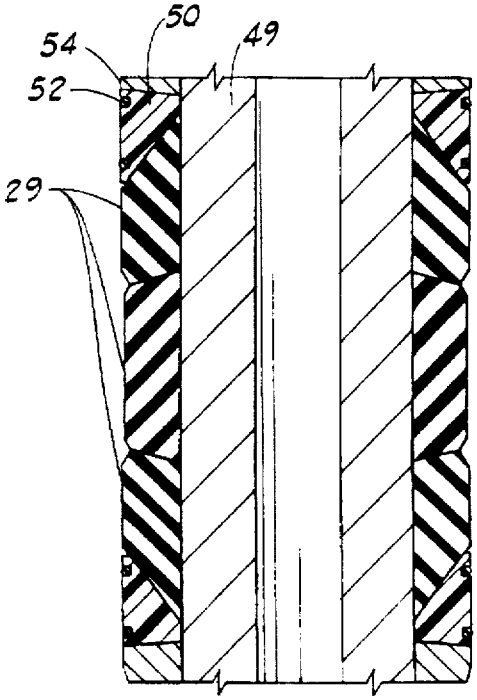
FIG. 3 is a cross-sectional side view of the preferred packer element retainer shoe discussed in U.S. patent application Ser. No. 08/442,448 assigned to the assignee hereof.

Referring now to FIG. 3 of the drawings. A broken away cross-sectional view of a tool having a mandrel 49 which has a packer element assembly 29 positioned thereabout, shows a packer shoe 50 embodying an improved packer shoe 50 discussed in detail in patent application Ser. No. 08/442,448. Packer shoe 50 is preferably made of a phenolic material available from General Plastics, 5727 Ledbetter, Houston, Tex., 77087-4095 which include a direction-specific laminate material referred to as GP3581. Alternatively, structural phenolics are available from commercial suppliers such as Fiberite, 501 West 3rd Street, Winona, Minn. 55987. Particularly well suited phenolic materials available from Fiberite include, but are not limited to, material designated as FM 4056J and FM 4005.

As can be seen in FIG. 3, each end most section of packer element 29 resides directly against shoe 50, which preferably does not employ a backup ring. Each shoe 50 preferably has circumferential grooves 54 about the external periphery of shoes 50 for accommodating a retaining band 52. Retaining band 52 serves to secure shoes 50 adjacent each respective end of packer element 29 after the shoes have been initially installed, during transit, and during the running in of the tool into a well bore prior to deploying the tool.

Figure 4A:
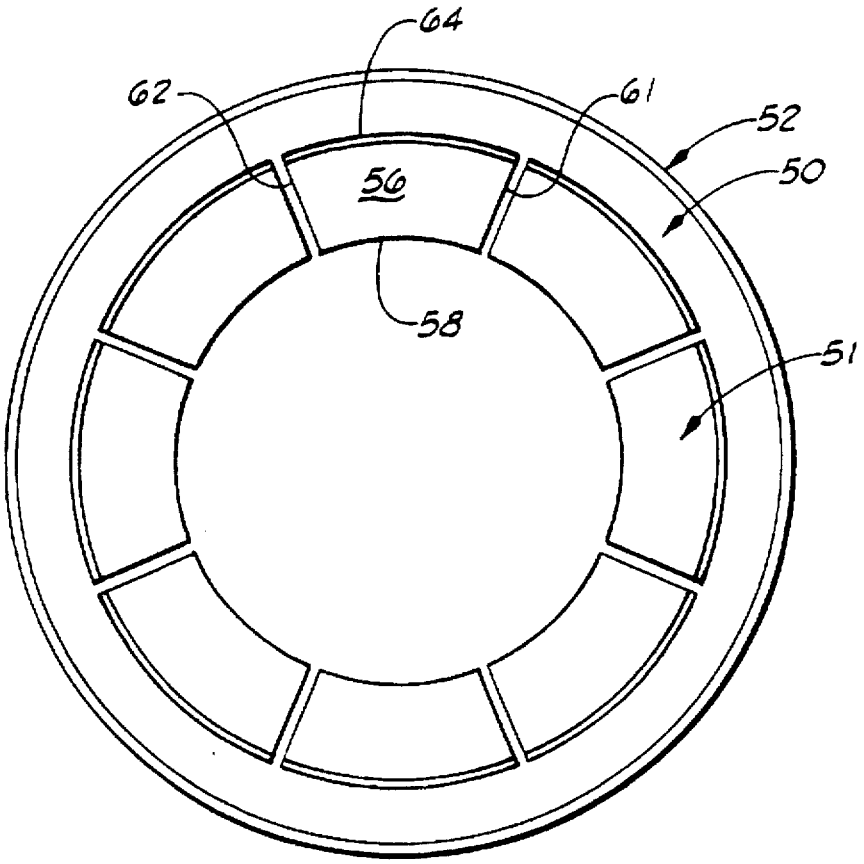
FIG. 4A is a top view of the preferred packer shoe and retaining band of the apparatus discussed in U.S. patent application Ser. No. 08/442/448. The retaining band is shown exageratedly expanded for clarity.
Figure 4B:
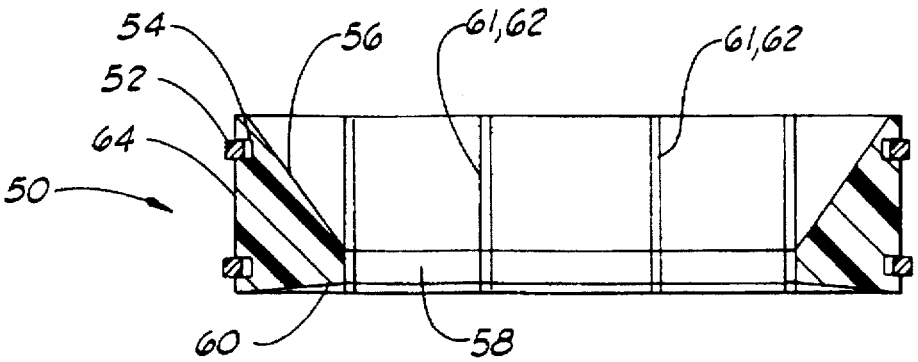
FIG. 4B is a cross-sectional side view of the packer element shoe shown in FIG. 4A.

Referring to FIG. 4A which is a cross-sectional view of the non-metallic packer shoe 50 depicted in FIG. 3. FIG. 4B is a view of shoe 50 as taken looking at the packer element surface 56 of shoe 50. Packer shoe 50 preferably has a plurality of individual shoe segments 51 to form a shoe that encircles a mandrel or center section of a downhole tool having a packer element. Shoe segments 51 preferably include an internal surface 56 which is shaped to accommodate the endmost portion of a packer element thereagainst. Surface 56 is therefore preferably sloped as well as arcuate to provide generally a truncated conical surface which transitions from having a greater radius proximate to external surface 64 to a smaller radius at internal diameter 58. The ends of shoe segment 50 are defined by surfaces 61 and 62 which are flat and convergent with respect to a center reference point CL which, if the shoe segments were installed about a mandrel, would correspond to the axial centerline of that mandrel as depicted in FIGS. 2 and 5. End surfaces 61 and 62 need not be flat and could be of other topology.

FIG. 4A illustrates shoe 50 being made of a total of 8 shoe segments to provide a 360° annulus, or encircling, structure to provide the maximum amount of end support for a packer element that is to be retained in an axial direction. A lesser amount, or greater amount of shoe segments can be used depending on the nominal diameters of the mandrel, the packer elements, and the wellbore or casing in which the tool is to be deployed.

Shoe retaining band 52, which is shown as being exageratedly expanded and distant from outer external surfaces 64 of shoe 50. Shoe retaining band 52 is preferably made of a non-metallic material such as composite materials available from General Plastics and Rubber Co., Inc., 5727 Ledbetter, Houston, Tex., 77087-4095. However, shoe retaining bands 52 may alternatively be of a metallic material such as ANSI 1018 steel or any other material having sufficient strength to support and retain the shoes in position prior to actually setting a tool employing such bands. Furthermore, retaining bands 50 may have either elastic or non-elastic qualities depending on how much radial, and to some extent axial, movement of the shoe segments can be tolerated prior to and during the deployment of the associated tool into a wellbore. For example rubber or elastomeric O-rings may be used to provide a more resilient and flexible retaining band if desired.

Shoe 50 as shown in FIG. 4B has two retaining bands 52 and respective band accommodating grooves 54. Grooves 54 are each located proximate to face 60 and proximate to upper most region where outer external surface 64 and arcuate surface 56 intersect, or the distance between the two is at minimum. As discussed earlier, a single band 52, appropriately sized and made of a preselected material, can be used. Alternatively, a multitude of bands appropriately sized and made of suitable material can be used in lieu of the preferred pair of retaining bands 52.

Tests have been performed using a downhole packer tool, similar to the representative bridge plug tool shown in FIG. 1, having the preferred packer shoe 50 wherein the shoe segments 51 were constructed in accordance with the above description and FIGS. 3–4 of the drawings. The test segments were made of a phenolic material obtained from General Plastics as referenced herein. Details of the test, as well as further details on the preferred slip and slip wedge construction shown in FIGS. 1–4 are set forth in patent application Ser. No. 08/442,448.

Referring now to FIG. 5 of the drawings. An exemplary downhole squeeze packer tool is shown and referred to generally as tool 102. Tool assembly 102, is somewhat similar in its overall design and operation as tool assembly 2 shown in FIG. 1. The particular tool of FIG. 5 is referred to as a packer as it provides for the flow of fluids or cement slurries within the tool upon a valve being positioned so as to allow communication between the annulus of the well and the interior of the tool. However, the present invention is equally applicable to bridge plugs as it is packers, or any other tool in which an expandable packer element is used to provide a seal between a well bore and a tool.

Returning to FIG. 5, tool 102 includes mandrel collar 104 being pinned to mandrel 149 by pins 108. Tool 102 includes a spacer ring 112 that is secured to mandrel 149 to provide an abutment to axially retain slip segments 118 which are positioned circumferentially about mandrel 149. Slip retaining bands 116 serve to radially retain slips 118 in an initial circumferential position about mandrel 149 as well as slip wedge 120. Bands 116 have the same desired characteristics of being sufficiently strong to hold the segments in place prior to actually setting the tool and yet be easily drillable when the tool is to be removed from the wellbore as discussed herein with respect to tool 2 in FIG. 1.

Slip wedge 120 is initially positioned in a slidable relationship to, and partially underneath slip segments 118 as shown in FIG. 5. Slip wedge 120 is shown pinned into place by pins 122. Located below slip wedge 120 is at least one packer element assembly 128, and as shown in FIG. 5, consists of three expandable elements positioned about mandrel 149. At both ends of packer element assembly 128 are packer shoes 150 embodying the present invention. Packer shoes 150 have retaining bands 152 installed in grooves 154 for the same reasons as discussed with respect to shoes 50 discussed and shown herein. However, packer shoes 150 include an improvement over packer shoes 50 discussed and claimed in patent application Ser. No. 08/442,448. Improved packer shoes 150 include recessed cavities or pockets 168 which accommodate gap-spanning, or bridging disks 170 that serve to limit the extrusion of expandable packer elements through gaps which form between adjacent shoes 150 upon tool 102 being set within a borehole.

Improved shoes 150 are illustrated and discussed in more detail herein. Returning, now to FIG. 5, located below the bottom most packer shoe 150 is lower slip wedge 120 pinned into mandrel 149 by pins 122. Lower slip wedge 120 coacts with lower slip segments 118 which also have retaining bands 116 to hold slip segments 118 initially in place. In this particular tool 102, the lower portion of the tool 130 provides an abutment for slip segments 118 to rest against. Furthermore, lower portion 130 of this particular tool has a sliding valve 133 positioned within that upon pressurization to prescribed pressure, travels longitudinally downward to open ports 134 thereby providing communication between the exterior of the tool and the interior of mandrel 149. Ultimately valve 133 will come to rest against stop 135 that is pinned into place by pins 132. It is again mentioned that tool assembly 102 is merely exemplary, and the improved packer element retaining shoe of the present invention can be adopted to any packer type tool having valves, open bores, or other mechanisms, as well as bridge plugs have permanent or temporary plugs installed therewithin.

Referring now to FIGS. 6–9 which focus on the improved packer element retaining shoe and gap-bridging structural members, or disks, of the present invention, and depicted as 150 and 170, respectively in the exemplary tool assembly 102 of FIG. 5.

Figure 6:
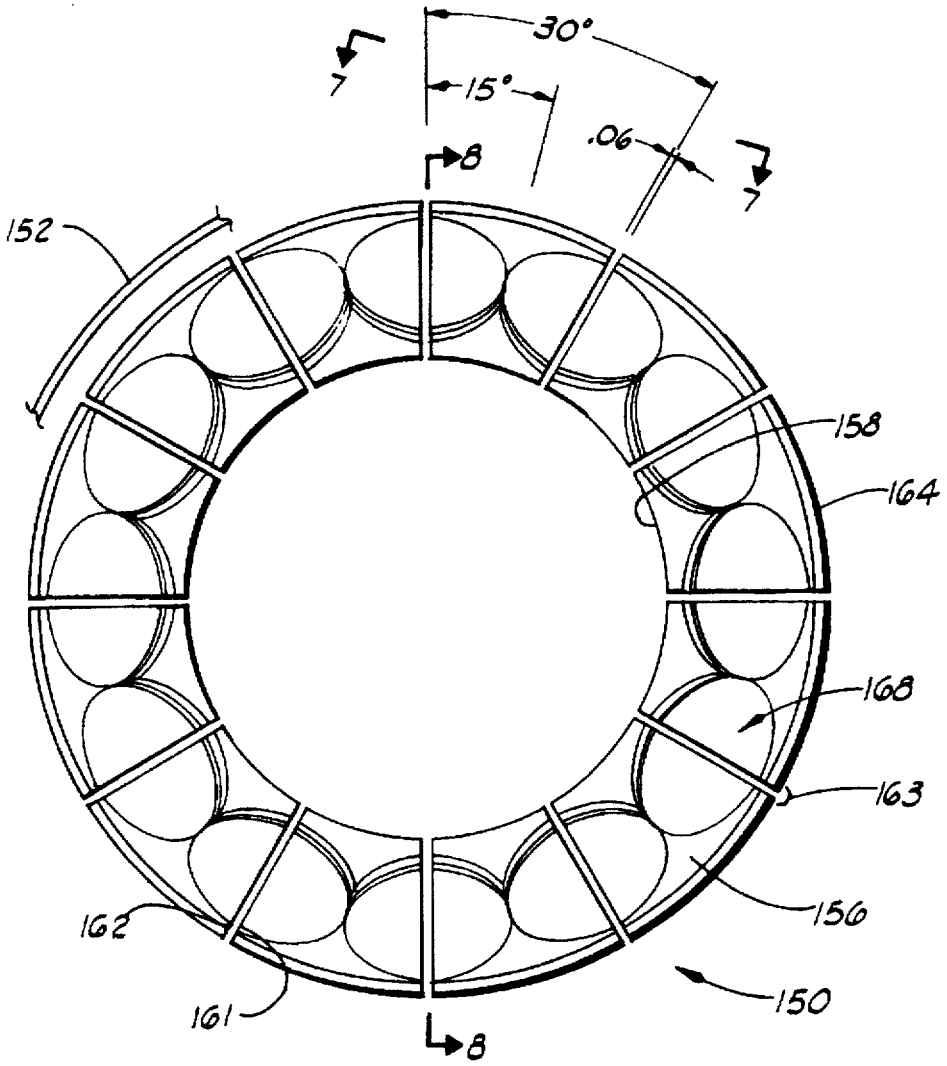
FIG. 6 is a front view of a preferred embodiment of a packer element shoe having a plurality of recessed pockets for accommodating embodiments of anti-extrusion disks of the present invention therein.

In FIG. 6, a front view of the preferred embodiment of a packer shoe consisting of a plurality of shoe segments 150 is shown. The plurality of segments form an annular structure around a packing element. Each segment 150 has a packer face 156 that when segment 150 is initially installed faces against packer element, an inner surface 158 usually having a nominal I.D. approaching that of the packer element assembly, an outer surface 164 that when segment 150 is initially installed faces outwardly away from the tool. Like in shoe 50 discussed previously, surface 156 is generally sloped and arcuate to provide a truncated conical surface which transitions from having a greater radius proximate to external surface 164 to a smaller radius at internal diameter 158. The slope of surface 156 is preferably approximately 45° as shown in FIG. 8. However, the exact slope is determined by the exterior configuration of packer element ends that are to be positioned and eventually be forced into contact with shoe 150 and face 156 in particular. Bottom face 160 of shoe 150 is slightly sloped, approximately 5°, if desired, but is also best determined by the surface of the tool which it eventually abuts against when tool 102 is set is a wellbore.

Returning to FIG. 6, retaining band 152, shown truncated and expanded away from segments 150, serve to initially hold segments in place prior to actually setting tool 102. Gap 163 is the space between adjacent surface ends 161 and 162 of segments 150 before or after tool 102 is set. Gap 163 can be essentially zero when the segments are initially installed about tool 102, however, for a tool having a nominal outside diameter of 9⅝ inches, a gap of 0.06 inches is typically provided for initial installation and gap 163 can extend beyond 0.5 inches after tool 102 has been set and packer element seals expanded outwardly to eventually contact and seal the wellbore, or casing. In the representative collection of segments 150, there are twelve such segments having an individual arc of approximately 30° to collectively complete a 360° encirclement, or annular structure, for a tool having a nominal outside diameter of 9⅝ inches. It is anticipated that for even larger nominal diameter tools, more shoe segments would be used to ensure proper radial movement of the shoe segments and support of the packer element upon setting the tool.

FIG. 8 shows a contour of an exemplary disk pocket 168 having essentially straight edges 169 on either side thereof to optimize spacing between, and positioning of, adjacent disks so as to provide the most amount of extrusion protection for a packer element positioned against the disk and associated shoes. As can be seen in FIG. 6, half of a particular pocket is located on each adjacent shoe segment. In other words the disk pocket is centered over the gap that it is to bridge. Thus maximum extrusion protection can be had upon the gap increasing as the shoe is forced further and further outward from the centerline of mandrel 149.

Figure 7:
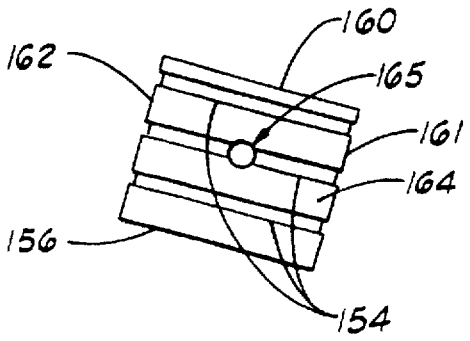
FIG. 7 is an exterior view of a shoe segment embodying the present invention taken along line 7—7 of FIG. 6.

FIG. 7 shows a view taken along 7—7 of FIG. 6 to better show exterior surface 164. Surface 164 preferably has at least one groove 154, and preferably three such grooves for accommodating a portion of a retaining band made of plastic, rubber, or, elastomeric material as previously described. It is not absolutely necessary to have grooves 154 but it is recommended to have such to ensure that retaining bands 152 avoid being damaged, as the tool is run downhole prior to setting, by the bands being flush with the exterior surface of the shoes. Exterior surface 164 may optionally be provided with a hole 165 extending radially inward to provide a point in which adhesive may be applied to better hold an O-ring within the associated groove if desired. Although three grooves have been used on the improved shoe segment shown, more grooves or less grooves could be used as deemed necessary.

Referring now to FIGS. 9A and 9B. FIG. 9B shows a back view of disk 170 having a packer element face 178, a pocket face 172, an upper edge 173, a lower edge 174, and straight sides 175. These edges and sides correspond to the configuration of pocket 168 so that disks 170 fit within pocket 168 when shoes 150 are installed in their initial position. A chamfer along edges 173 and 174 on pocket face 172 facilitates installation into pockets 168. Preferably, on a 9⅝ inch nominal diameter packer tool, the disks are approximately 0.23 inches thick. However, the exact thickness is determined by strength characteristics of the disk material and the anticipated loads to be placed thereon.

The material in which shoes 150 and bridging disks 170 are made are preferably made of a composite material available from General Plastics and Rubber Co. Inc., 5727 Ledbetter, Houston, Tex., 77087-4095. A particularly suitable material for at least a portion of the shoe assembly includes a direction specific composite material referred to as GP4043 available from General Plastics. Alternatively, structural phenolics available from commercial suppliers such as Fiberite, 501 West 3rd Street, Winona, Minn., 55987 include material designated as FM 4056J and FM 4005. Both the improved shoes and bridging disks can be molded or machined depending on the characteristics of the selected material in which the shoes or disks are to be made from.

Improved shoes 150 having bridging disks 170 are especially beneficial when used in connection with downhole packer type tools of larger nominal outside diameters, or when encountering elevated downhole differential pressures, or elevated temperatures such as, but not limited to, those exceeding six (6) inches, 10,000 psi, 250° F.. However, it should be understood that the disclosed improved shoes may be used in connection with packer type tools of lesser or greater: diameters, differential pressure ratings, and operating temperature ratings. Furthermore, although it is preferred that the bridging disks be made of a direction-specific laminate material, or any other suitable non-metallic composite structural material, the bridging discs of the present invention may also be made of metallic material if desired. Such metallic materials include, but are not limited to, brass, aluminum, and low strength steels that would be sufficiently strong, corrosive-resistant, and drillable if drillability is a concern.

Although the disclosed invention has been shown and described in detail with respect to a preferred embodiment, it will be understood by those skilled in the art that various changes in the form and detail thereof may be made without departing from the spirit and scope of this invention as claimed.

What is claimed is:

1. A downhole apparatus for use in a wellbore comprising:

a) a mandrel having an axial centerline;

b) a slip means disposed on the mandrel for grippingly engaging the wellbore when set into position;

c) at least one packer element to be axially retained about the mandrel and located at a preselected position along the mandrel defining a packer element assembly;

d) at least one packer element retaining shoe made of a plurality of segments for axially retaining the at least one packer element about the mandrel, the shoe segments further having a cavity for accommodating at least a portion of at least one shoe segment to shoe segment gap-spanning structural member;

e) at least one shoe segment to shoe segment gap-spanning structural member installable into the cavity; and f) means for retaining the shoe segments in an initial position about the mandrel;

wherein the shoe segment to shoe segment gap-spanning member is of such size and configuration to span a gap that forms between adjacent shoe segments upon the tool being set in the wellbore.

2. The apparatus of claim 1 wherein at least one of the shoe segments is made of a phenolic material.

3. The apparatus of claim 1 wherein at least one of the shoe segments is made of a laminated non-metallic composite material.

4. The apparatus of claim 1 wherein the shoe retaining means comprises at least one retaining band made of a non-metallic material.

5. The apparatus of claim 1 wherein the shoe segment has an external face having at least one groove therein to accommodate at least one retaining band.

6. The apparatus of claim 1 wherein the shoe segment gap-spanning structural member is a disk having a packer face, a shoe face, and having a pair of approximately straight side, the disk further being made of a non-metallic material.

7. The apparatus of claim 1 wherein the mandrel is made of a non-metallic composite and the slip means is made at least partially of a non-metallic composite.

8. A downhole apparatus for use in a well bore comprising:

a) a mandrel made of a non-metallic material and having an axial centerline;

b) a collar spacer ring made of a non-metallic material being secured to the mandrel;

c) a first plurality of upper slip segments proximate to the spacer ring and encircling a portion of the mandrel, the upper slip segments being restrained in an initial position by a retaining means, the upper slip segments being made of a non-metallic material forming an upper slip means for grippingly engaging the wellbore when set into position, each slip segment having a planar bearing surface;

d) a non-metallic upper slip wedge encircling and slidable along a portion of the mandrel, the slip wedge located adjacent to the upper slip segments, the upper slip wedge further having a plurality of planar bearing surfaces inclined with respect to the axial centerline of the mandrel being complementary to and for coacting with the planar bearing surfaces of respective slip segments;

e) a first plurality of non-metallic packer element retaining shoe segments encircling a portion of the mandrel and being positioned and restrained by a retaining means so as to be proximate to the upper slip wedge, the shoe segments having a surface configured to accommodate an end portion of a packer element assembly and further having a cavity for accommodating at least a portion of a shoe segment to shoe segment gap-spanning structural member;

f) a packer element assembly comprising at least one packer element having a first end portion proximate to and accommodatable by the internal surface of the first shoe segments, the packer assembly generally encircling a portion of the mandrel;

g) a second plurality of non-metallic packer element retaining shoe segments being positioned and restrained by a retaining means so as to be proximate to an opposite end of the packer assembly and encircling a portion of the mandrel, the second plurality of shoe elements having a surface configured to accommodate the opposite end of the packer element assembly and further having a cavity for accommodating at least a portion of a shoe segment to shoe segment gap-spanning structural member;

h) a lower non-metallic slip wedge encircling and slidable along a portion of the mandrel, the lower slip wedge located adjacent to a second plurality of lower slip segments, the lower slip wedge further having a plurality of planar bearing surfaces inclined with respect to the axial centerline of the mandrel being complementary to and for coacting with the planar bearing surfaces of respective slip segments;

i) a second plurality of slip segments proximate to a second end portion of at least one packer element and encircling a portion of the mandrel, the second plurality of slip segments made of a non-metallic material and being initially restrained by a retaining means to form a lower slip means for grippingly engaging the wellbore when set into position, each lower slip segment having a planar bearing surface; and j) an end most terminating portion to the downhole tool, the terminating portion being proximate to the lower slip segments and being secured to the mandrel;

wherein the shoe segment gap-spanning structural member serves to limit the extrusion of the packer element proximate to the associated retaining shoe.

9. The apparatus of claim 8 wherein at least one of the components set forth therein is made of phenolic, laminated composite, or engineering grade plastic.

10. The apparatus of claim 8 wherein at least one of the components is secured to the mandrel by pins.

11. The apparatus of claim 8 wherein all of the components are essentially made of composite, phenolic, engineering grade plastics, or non-metallic materials.

12. The apparatus of claim 8 wherein at least one of the shoe segment retaining means comprises at least one retaining band made of composite, phenolic, or engineering grade plastic.

13. The apparatus of claim 12 wherein there is at least one groove in at least one retaining shoe segment for accommodating at least one retaining band therein.

14. The apparatus of claim 12 wherein there are three grooves in at least one retaining shoe segment, each groove accommodating at least one retaining band made of a non-metallic material.

15. The apparatus of claim 12 wherein each retaining segment has a nominal circumferential width corresponding to an approximate 30 degree arc.

16. A method of limiting the extrusion of packing elements installed about a mandrel of a downhole tool upon the tool being set in a wellbore, the method comprising:

a) providing at least one packer element retaining shoe having a plurality of shoe segments, each having a packer element face in annular relationship with the mandrel, b) providing at least one cavity in at least one of the shoe segments;

c) providing and installing at least one shoe segment to shoe segment gap-spanning structural member that is sized and configured to be initially accommodated by at least one of the cavities provided in at least one of the shoe segments, the structural member further being sized and configured to allow for the member to substantially bridge a gap that develops between adjacent shoe segments upon expansion of the packer element;

d) providing means for retaining the shoe segments and the shoe segment gap-spanning structural members in an initial position about the mandrel; and e) expanding the packer element radially outward so as to cause a portion of the packer element to be forced against the shoe segment gap-spanning structural member and the packer face of the associated shoe segment, which in turn causes adjacent segmented shoe segments to form a gap therebetween and in which the gap-spanning structural member limits extrusion of the packer element proximate to the retaining shoes.

17. The method of claim 16 wherein the gap-spanning structural member is configured to resemble a disk and wherein at least one of the cavities of at least one of the shoe segments accommodates a portion of two such disks initially located adjacent to each other.

18. The method of claim 16 wherein at least one of the shoe segment gap-spanning structural members and one of the shoe segments is made of a composite, phenolic, engineering grade plastic, or non-metallic materials.

19. The method of claim 16 wherein the shoe segment retaining means comprises at least one non-metallic band disposed about the periphery of the shoe segments to hold the shoe segments in an initial annular relationship with the packer element and the mandrel of the downhole tool.

20. The method of claim 17 wherein at least one of the disks have a pair of essentially straight edges to optimize the spacing of the initial positioning and orientation of the disks.

21. The method of claim 16 wherein the majority of the components of the downhole tool are made of a non-metallic material.

* * * * *